US005633058A

United States Patent [19]

Hoffer et al.

[11] Patent Number: 5,633,058

[45] Date of Patent: May 27, 1997

[54] MESSAGE-INDICATING SELF-WOUND TAPE AND METHOD OF MAKING SAME

[76] Inventors: Erik Hoffer, 2048 Amwell Rd., Somerset, N.J. 08873; Stephen G. Sobel, 45 Krakow St., Garfield, N.J. 07026

[21] Appl. No.: 523,635

[22] Filed: Sep. 5, 1995

[51] Int. Cl.[6] ..... B65D 55/00; B42D 15/00

[52] U.S. Cl. ..... 428/40.1; 156/190; 156/191; 156/192; 156/277; 156/278; 283/81; 283/101; 283/108; 283/109; 428/41.4; 428/41.8; 428/42.1; 428/201; 428/202; 428/203; 428/204; 428/205; 428/352; 428/354; 428/906; 428/916

[58] Field of Search ..... 428/40.1, 41.4, 428/41.8, 42.1, 195, 201, 202, 203, 204, 205, 352, 354, 916, 915, 906; 283/81, 109, 101, 108; 156/190, 191, 192, 277, 278

[56] References Cited

U.S. PATENT DOCUMENTS

| | | | |
|---|---|---|---|
| 3,631,617 | 1/1972 | Pekko | 283/101 |
| 4,082,873 | 4/1978 | Williams | 428/40 |
| 4,121,003 | 10/1978 | Williams | 428/42.1 |
| 4,246,307 | 1/1981 | Trautwein | 428/43 |
| 4,331,727 | 5/1982 | Maas | 428/41.8 |
| 4,432,630 | 2/1984 | Haas | 355/1 |
| 4,542,982 | 9/1985 | Haas | 355/40 |
| 4,557,505 | 12/1985 | Schaefer et al. | 283/81 |
| 4,718,553 | 1/1988 | Adamoli et al. | 206/459 |
| 4,760,919 | 8/1988 | Pereyra | 206/484.2 |
| 4,779,120 | 10/1988 | Haas | 355/40 |
| 4,876,123 | 10/1989 | Rivera et al. | 428/34.2 |
| 4,903,254 | 2/1990 | Haas | 368/327 |
| 4,931,327 | 6/1990 | Liu et al. | 428/36.5 |
| 4,972,953 | 11/1990 | Friedman et al. | 206/459 |
| 4,987,849 | 1/1991 | Sherman | 116/206 |
| 4,998,666 | 3/1991 | Ewan | 229/102 |
| 5,053,339 | 10/1991 | Patel | 436/2 |
| 5,058,088 | 10/1991 | Haas et al. | 368/327 |
| 5,060,848 | 10/1991 | Ewan | 229/102 |
| 5,064,664 | 11/1991 | Hustad | 428/87 |
| 5,082,702 | 1/1992 | Alband | 428/36.92 |
| 5,103,979 | 4/1992 | Hustad | 206/459 |
| 5,107,470 | 4/1992 | Pedicano et al. | 368/327 |
| 5,149,578 | 9/1992 | Wheatley et al. | 428/213 |
| 5,312,680 | 5/1994 | Simpson | 428/321.5 |

*Primary Examiner*—Nasser Ahmad

*Attorney, Agent, or Firm*—Harold James, Esq.; Robert L. Epstein, Esq.; James & Franklin

[57] ABSTRACT

A tape is adapted to be secured to a container or other object which when removed therefrom causes the display of a message which was formerly not visible, such as a notification that the object has been tampered with, the tape being provided on one surface with an adhesive layer so that it can be attached to the object and provided on its opposite surface with a release layer so that it can be wound upon itself and readily dispensed without having to remove a protective liner therefrom, the message displayed by the tape both when initially secured to said object and after removal therefrom being located on said one surface of said tape, whereby said tape may be readily and inexpensively manufactured and readily dispensed from appropriate mechanical equipment in large quantity applications.

12 Claims, 2 Drawing Sheets

FIG. 1
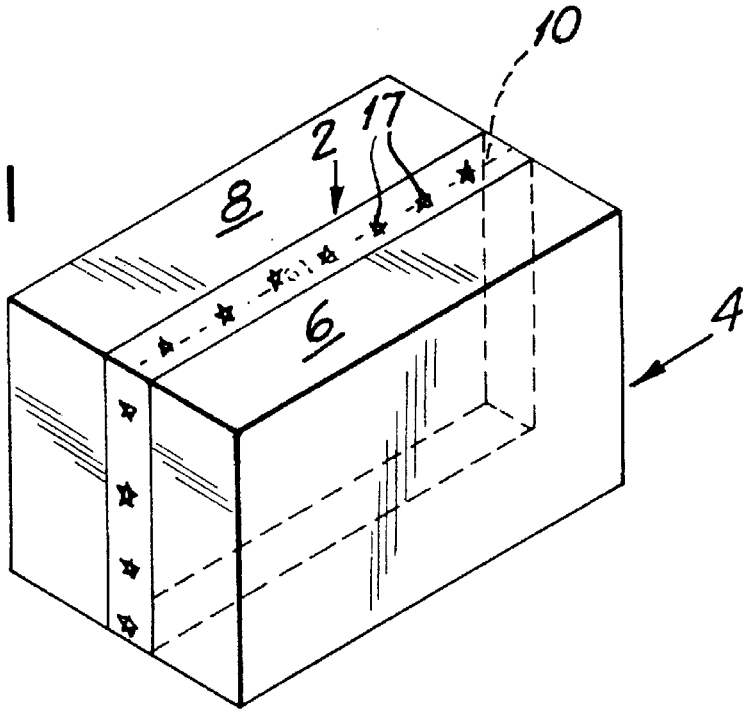
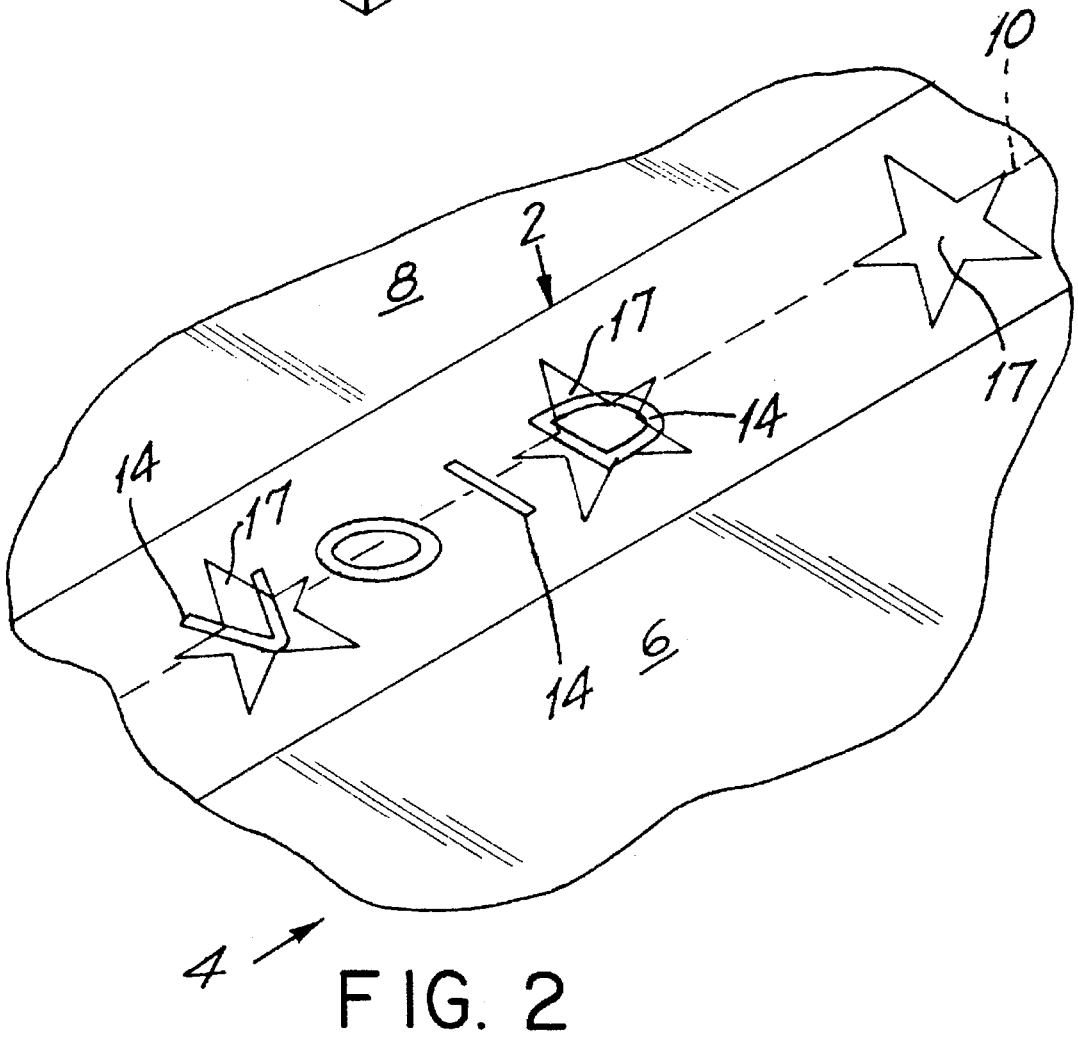
FIG. 2

FIG. 3
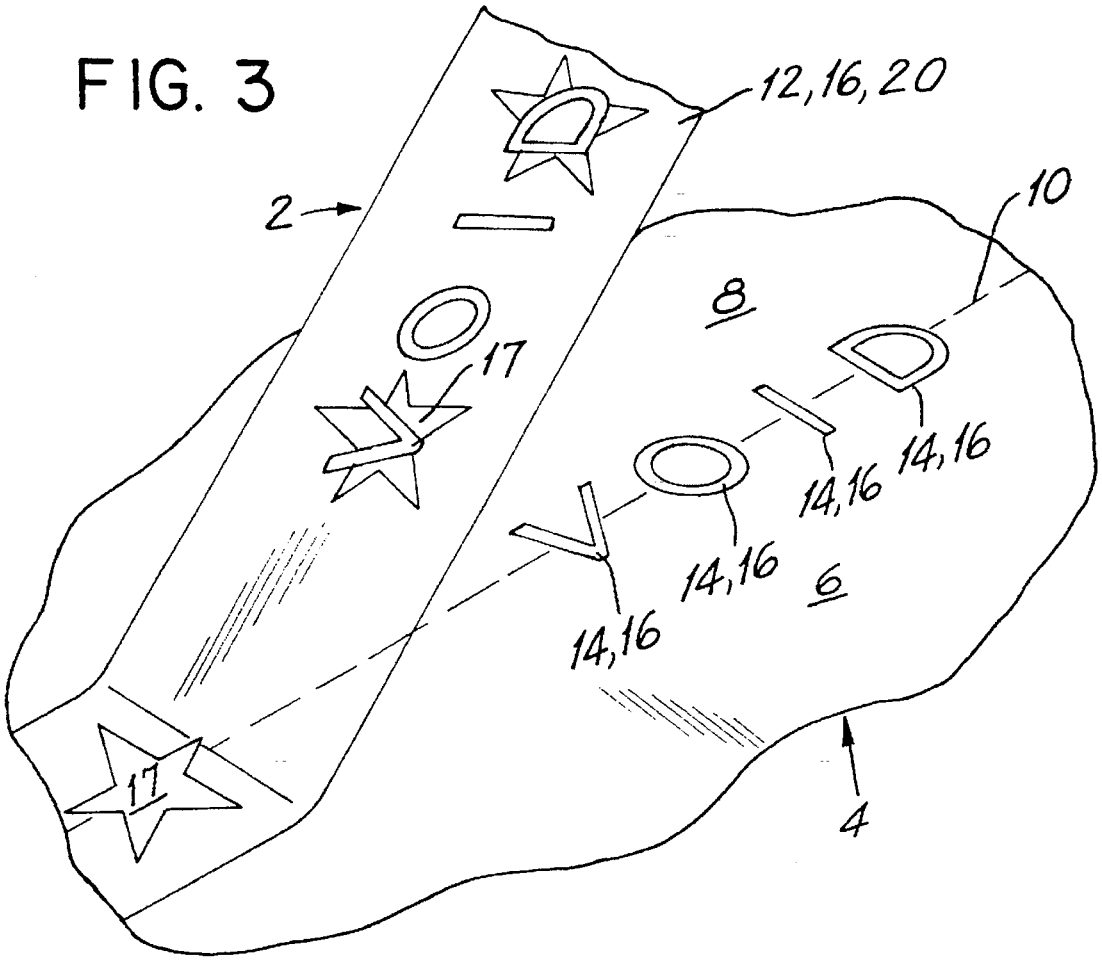
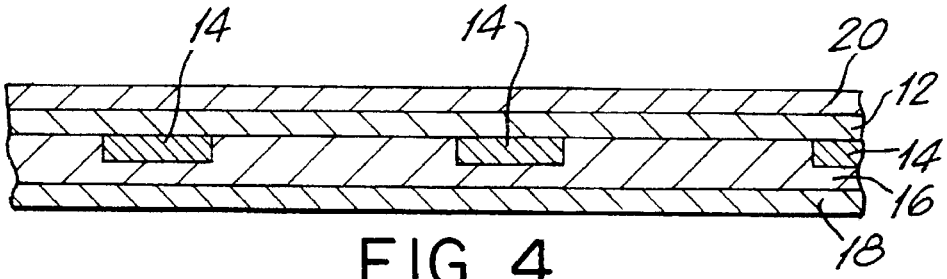
FIG. 4
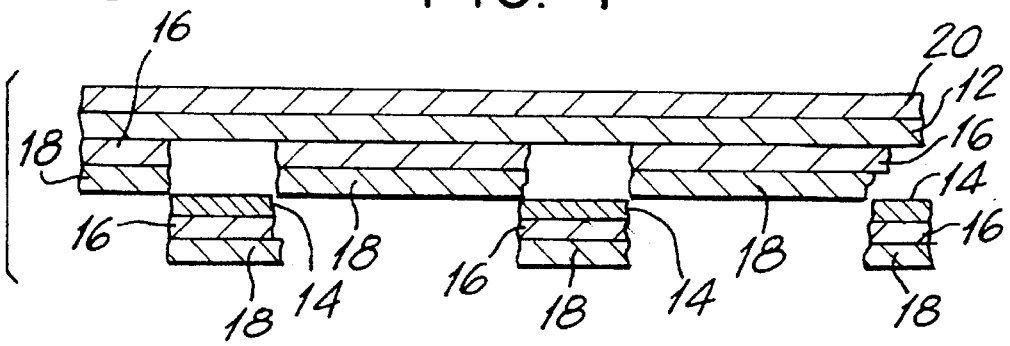
FIG. 5

MESSAGE-INDICATING SELF-WOUND TAPE AND METHOD OF MAKING SAME

BACKGROUND OF THE INVENTION

The invention relates to a composite tape adapted to be secured to an object and, when removed from that object, to provide a visible indication ("message") on the object which was not theretofore visible, which tape can be readily applied to a successive plurality of such objects by means of mechanical equipment. A primary, but not exclusive, use for such a tape is to indicate when the security of the object to which it has been attached has been compromised.

The security of objects shipped from one place to another is extremely important, and represents a very significant problem. Far too often packages are opened in transit and the contents surreptitiously removed. Shipments destined for particular destinations such as foreign countries are wrongfully re-routed. Unbroken chain of custody for forensic evidence must be established. Almost every company has some level of exposure to industrial theft, diversion, tampering or pilferage. Industry today expends vast sums in an attempt to meet these problems.

One approach that has had considerable success has been to provide a tape designed to be secured to an object such as a package, which tape has one appearance when thus applied, but produces a different and distinctive appearance if the tape has been removed, even when an attempt is made to re-apply the tape. For example, if such a tape is used for the sealing of a package to prevent access to the contents of the package, surreptitious removal of the tape will create that different appearance, such as the display of a warning word such as "Void".

Since tapes of the type in question are commonly used as sealing tapes for cartons, applied over the joints of such cartons to hold flaps in place and thus protect the contents of the cartons from pilferage, they are sufficiently substantial in nature to accomplish that result. Usually, in the form in which they are applied, they transmit certain intelligence to viewers, such as a trademark, a logo, or other information such as "Fragile" or "This Side Up". When they are removed from the container in order to provide access to the contents, however, they leave behind on the container some indication, such as the words "Void" or "Opened", to indicate that the container has been tampered with, and this is done in such a way as, for all practical purposes, to prevent re-application of the tape to the container from obscuring that revealed indication. This conventionally involves taking a backing sheet of sufficient structural integrity to function as a carton seal and applying thereto coatings which can accomplish the desired result. The nature of those coatings and the ease or difficulty of applying them to the backing sheet constitute significant industrial problems.

Such a tape has on one exposed surface a layer of adhesive by means of which the tape is secured to the container or other object to which it is applied. In most applications tapes of this type are employed to seal a large number of successively presented containers, so that as a practical matter a very great length of tape must be initially provided. The only practical way for providing such an extreme length of tape is in the form of a roll, but that means that the adhesive layer exposed on one turn of tape is pressed against and tends to stick to the other exposed surface of the next adjacent turn of tape in the roll. Accordingly the exposed adhesive coating has been provided with a sheet of lining material which separates the adhesive coating from the adjacent turn of the tape and thus prevents the two from sticking together. However, the use of such a separating lining sheet involves significant problems. In the first place, that separating sheet adds weight and bulk to the roll of tape, thus limiting the size of rolls which can be handled even by machinery. By eliminating the separating sheet rolls of tape as long as 3–4000 lineal feet are made practical. In the second place, the separating sheet must be removed from the tape before the tape is applied to the carton which it is to seal and then discarded. This not only involves action on the part of the operator which reduces his efficiency, but also involves the use of extra material. In the third place, and most significantly, the use of such a lining sheet which must be removed and discarded makes it difficult if not impossible to apply the tape to cartons by means of mechanical, and particularly automatic, equipment, yet the use of such equipment for sealing cartons in mass production applications is virtually obligatory.

SUMMARY OF THE INVENTION

It is also important in tapes of the type here involved that their initial appearance, before they are applied to the cartons and after they are initially applied to the cartons, give no indication of the message that they will convey when the tape is removed, or even that the conveyance of such a message is inherent in the tape.

It is therefore the prime object of the present invention to provide a self-wound tape which can readily be applied by mechanical, and particularly automatic, machinery to products so as to provide a validating or tamper-indicating message when appropriate.

It is another object of the present invention to provide such a tape in which the message-producing portions are all on one side of the structural tape layer, thus adding security and facilitating manufacture.

It is yet a further object of the present invention to provide an improved method of making tapes of this general character which not only makes the manufacture of such tapes easier and less expensive but also produces a tape of improved operational characteristics.

The tape of the present invention accomplishes the objectives above set forth in signal fashion, yet it may be manufactured by a process which is simple and easy to perform, particularly because all of the message-producing and adhesive constituents are applied to one surface of the structural tape. Moreover, the use of a separating liner between overlapping turns of the tape when formed into a roll is entirely eliminated. Instead the other surface of the tape, the surface which does not carry the message-producing and adhesive constituents, is itself provided with a release coating. Hence the tape of the present invention can be readily used with mechanical, and particularly automatic, tape-applying equipment without having to deal with the separation, removal or disposal of separating lining.

To these ends, the said one surface of the structural tape is provided with a particular appearance, preferably involving an overall background color or colors to which some intelligence such as a trademark, logo or explanatory material may be added so as to be visible through the tape and outermost release coating. Also applied to said one surface of the tape is a release coating applied in patterned form, with the pattern representing the message to be conveyed if and when the tape has been applied to and then removed from an object. The adhesive layer for securing the tape to the object is applied to at least a part and preferably all of said one surface of the composite tape, the surface opposite that which carries the first mentioned release coating. The backing sheet and the release coating applied to said other surface thereof are preferably transparent. That portion of the print or other means used to produce the original appearance of the tape which is in contact with the backing sheet will adhere more strongly to that sheet than to the adhesive layer, whereas the second release layer, interposed as it is between the print or other means and the backing sheet will cause that print or the like to adhere more readily to the adhesive layer than to the backing sheet. Since that second release layer preferably cannot be made out through the backing layer, its presence will not be apparent when the tape is in its initial position or when the tape has been applied to a carton, but if the tape be pulled from the carton as if, for example, one would seek to open the carton flaps and gain access to the carton interior, the print or other means overlying the patterned release coating will separate from the remainder of the print and because of its pattern will convey the desired message. Because of the physical separation of portions of the print layer involved, any attempt to replace the tape on the carton will not obliterate or destroy the message produced by initially removing the tape.

The preferred embodiment of the invention will be here specifically disclosed in the form of a tape designed to seal a carton or other object and to visually indicate when the security of that carton or object has been compromised, and in particular to seal the flaps of a container, and with the tape having a normal or initial appearance produced by a layer of printed material, but it will be understood that this is by way of example only. The tape can of course be used also in connection with bags and envelopes such as those used for the transportation of money, documents and forensic evidence. It is the perfect medium for tamper indication and therefore ensures the reliability of the chain of custody in connection with forensic evidence which must be shipped from one place to another. One receiving such a package or object with the seal intact is assured that his package is in the same condition as it started. The tape can also be used, whether for sealing purposes or otherwise, as a self-validating indication, protecting the items to which it is secured from forgeries by having its message hidden from view prior to use. When such an object is received at its destination removal of the tape will present certain visible intelligence by means of which the receiver can determine the genuineness of the product. For example, many products are shipped from this country for resale in a foreign country but such shipments are sometimes wrongfully returned to this country. If such products are provided with a tape which normally displays a message such as "To Be Removed by Customs" and when removed displays the intelligence "For Export Only", that will enable Customs personnel to readily identify such wrongfully returned products.

BRIEF DESCRIPTION OF THE DRAWINGS

To the accomplishment of the above, and to such objects as may hereinafter appear, the present invention relates to the construction of an intelligence-indicating self-would tape and a method of making same, as defined in the appended claims and as described in this specification, taken together with the accompanying drawings, in which:

FIG. 1 is a three-quarter perspective view of a carton to which a sealing tape made in accordance with the present invention has been applied;

FIG. 2 is a fragmentary perspective view, on an enlarged scale, of a portion of the carton of FIG. 1 with a tape applied;

FIG. 3 is a view similar to FIG. 2 but showing the appearance of that portion of the carton when the tape has been lifted therefrom;

FIG. 4 is a cross-sectional view of the tape of the present invention in its initial and applied form, the view being diagrammatic, with the thicknesses of various layers being shown in idealized fashion in order best to illustrate the construction and function of the tape, and FIG. 5 is a view similar to FIG. 4 but showing the relationship of the parts when the tape has been removed from its initial application to the carton.

DETAILED DESCRIPTION OF THE PREFERRED EMBODIMENT

As indicated, the preferred embodiment of the present invention here illustrated is in the form of a long length of continuous composite tape from which separated lengths generally designated 2 are adapted to be secured to an object such as a carton generally designated 4, that carton having top flaps 6 and 8 which when folded down to close the carton meet at line 10. As is conventional, and as shown in FIG. 1, the tape 2 is wrapped around the carton 4 so as to overlie the line 10 and thus retain the flaps 6 and 8 in closed position. In order to gain access to the interior of the carton 4 in a manner such that the condition of the carton 4 will not indicate that entry, one must remove the tape 2 from over the line 10 so that the flaps 6 and 8 can be opened to expose the carton contents and then re-close and re-seal the carton with the tape 2 in such a manner that the earlier removal of the tape is not revealed. The tape of the present invention is so constructed and fabricated as to prevent that from happening.

The composite tape 2 comprises a preferably transparent backing sheet defining a layer 12 of sufficient structural integrity to be usable as described. The first step in the production of the composite tape is to provide on one side of the backing sheet 12, which is to be its lower surface, a patterned layer 14 of suitable release material, the pattern being selected so as to produce a desired message if and when the applied tape is tampered with.

Next the same lower surface of the backing sheet 12 to which the patterned release material 14 has been applied is provided with a layer 16 of print or other visible substance which can be seen through the backing sheet 12 and the release material 14 and which as thus seen exhibits certain intelligence, such as an overall background color and preferably some trademark, logo or other normal message, specifically represented in the drawings by a star 17. The layer 16 is in contact with the backing sheet 12 between the portions of the release layer 14 and it also preferably underlies the release layer 14 itself.

Next an adhesive layer 18 is applied over the lower exposed surface of the tape, that layer 18 being effective to secure the tape 2 to the carton 4 when the former is applied thereto. The layer of print 16 adheres relatively strongly to the backing sheet 12, it may adhere less strongly to the adhesive layer 18, and it adheres more strongly to the adhesive layer 18 than it adheres to those portions of the backing sheet 12 where the release layer 14 is present. The adhesive layer 18 entraps all of the ink and graphic features produced directly or potentially by the layers 14 and 16.

At some point in the process, and preferably after the layers 14, 16 and 18 have been applied to backing sheet 12, a second release layer 20 is applied to the upper surface of the backing sheet 12, the release layer 20 normally adhering to the backing sheet 12 and being relatively non-adherent to the adhesive layer 18. Hence when lengths of the composite tape 2 are rolled up so that each turn of the tape has its release layer 20 in engagement with the adhesive layer 18 of the adjacent turn, the turns will not stick together and the tape can readily be unrolled without having to provide and deal with the separating lining sheets of the prior art.

It will be noted that all of these operations are of a type which can readily be performed by passing the backing sheet 12 through appropriate automatic printing and coating machinery, so that the tape can be readily fabricated, and that all but the application of the second release layer 20 are performed on the lower side of the backing sheet 12.

When the tape 2 is applied the essential transparency of the backing sheet 12 and second release layer 20 and the essential invisibility of the patterned release layer 14 will give the tape the appearance desired, as indicated by an overall background color and the stars 17. The tape 2 when applied will be as schematically indicated in FIG. 4. However, if one removes the tape 2 from the carton 4, as shown in FIG. 3, that portion of the background layer 16 in direct engagement with the backing sheet 12 will peel off with that sheet, while that portion of the layer 16 which is separated from the backing sheet 12 by the patterned release layer 14 will remain with the adhesive layer 18 and hence will remain in place on the carton flaps 6 and 8, thus exhibiting the message of the pattern, here illustrated as the warning word "Void". Because all of the layers 14, 16 and 18 are on the same side of the backing sheet 12, and because the layer 16 is actually torn when the backing sheet 12 is removed, any attempt to restore the tape 2 to its initial position will still leave the "Void" message readily visible. The adhesive layer 18 may itself separate into sections corresponding and remaining attached to the separated sections of the background layer 16, as is here specifically illustrated, or the adhesive layer 18 may remain on the carton, with the portions of the background layer 16 not registering with the patterned release layer 14 separating therefrom. Also, it will be understood that although as here specifically illustrated the pattern of the release layer 14 defines the desired message in positive form, the release layer 14 could be so configured as to define the message in negative form.

The backing sheet 12 may be formed of matte or clear plastic such as polyester, styrene, polypropylene, polyethylene, polyvinyl chloride, polyamides or other suitable plastics.

The patterned release layer 14 is preferably a silicone material but varnish, silicate and ink vehicles can be used. It is formulated so as to cause the print layer 16 to adhere preferentially to the adhesive layer 18 rather than the backing sheet 12. This can be done either by having the release layer 14 be less adherent to the backing sheet 12 than it is to the print layer 16, as is shown in the drawings, or by having the print layer 16 be less adherent to the release layer 14 than it is to the adhesive layer 18, or both.

The print layer 16 may be formed in any suitable manner, preferably by a conventional solvent base ink. Because portions of that layer 16 break away from one another when the tape is removed from the carton it is not possible to re-apply the background color to the tape after it has been removed and cause it to look the same as the original tape.

The adhesive layer 18 may be formed of any suitable, preferably solvent-based, adhesive which has the desired adhesive characteristics with respect to the type of object to which the tape is to be secured. As is well known to those in the adhesive field, adhesives are often specially formulated to satisfy particular application requirements, so the specific nature of the adhesive layer 18 may vary widely, and for each specific adhesive composition specific modifications of the composition and characteristics of the release layers 14 and 20 will also be called for, but all of this is common and well within the ability of those skilled in the art.

The release layer 20 is preferably formed of a suitable silicone material, preferably a U-V 100% solids silicone product, but solvent silicone is also often used.

Since conventional hand-held tape applicators and packaging tape machines are not adapted to remove liner sheets when automatically closing cartons, and since those liner sheets are otherwise undesirable because of weight and bulk, the need for disposal and the like, the fact that the message-indicating tape of the present invention eliminates the need for such liner sheets is an important industrial advantage. Moreover, the arrangement of the operative parts of the tape not only makes for simplicity and inexpensiveness of construction while at the same time producing reliably functioning and very effective security, but also simplifies the method of manufacture and reduces cost.

While but a single embodiment of the present invention has been here specifically disclosed, it will be apparent that many variations may be made therein, all within the scope of the present invention as defined in the following claims.

We claim:

1. A message-indicating self-wound elongated composite tape comprising a backing sheet having upper and lower surfaces, a first release coating on said lower surface covering only a portion of said lower surface in a pattern which when viewed conveys certain intelligence, a printed layer covering at least portions of said first release coating and said lower surface of said backing sheet not covered by said first release coating, and an adhesive layer substantially covering and exposed at the lower surface of said composite tape, said printed layer where it engages said backing sheet adhering more strongly to said backing sheet than to said adhesive layer, said first release coating ensuring that said printed layer where it engages said first release coating adheres more strongly to said adhesive layer than to said backing sheet, and a second release coating on said upper surface, said tape being wound on itself to form a multi-turn roll in which said second release coating of one turn directly engages said adhesive layer of the adjacent turn.

2. The tape of claim 1, in which said first and second release coatings are essentially non-visible when in place on said composite tape.

3. The tape of claim 1, in which said backing sheet is formed of a light-transmissive plastic.

4. The tape of claim 1, in which said backing sheet is formed of a light-transmissive plastic from the group consisting of polyester, polypropylene, polyethylene and polystyrene.

5. The tape of claim 1, in which said backing sheet and said release coatings are light-transmissive.

6. The tape of claim 1, in which the first release coating comprises silicone.

7. The tape of claim 1, in which the second release coating comprises silicone.

8. The tape of claim 1, in which said first and second coatings comprise silicone.

9. The tape of claim 1, in which said adhesive layer comprises a solvent-based acrylic.

10. The tape of any of claims 1–9, in which said printed layer comprises background color and a visible graphic different in appearance from said pattern of said second release coating.

11. The process of making an intelligence-indicating elongated self-wound composite tape, said tape comprising a backing sheet having upper and lower surfaces, said method comprising (a) first applying to the lower surface of said sheet a first release coating in a pattern which when viewed conveys certain intelligence, (b) then applying to said lower surface of said backing sheet, including at least portions of said first release coating, a printed layer, (c) then substantially covering the thus produced lower surface of said composite tape with a layer of adhesive, (d) at some time in the process applying a second release coating to the upper surface of said backing sheet, and (e) winding said tape upon itself to form a multi-turn roll in which said second release coating of one turn directly engages said adhesive layer of the adjacent turn.

12. The process of making an intelligence-indicating elongated self-wound composite tape, said tape comprising a backing sheet having upper and lower surfaces, said method comprising (a) first applying to the lower surface of said sheet a first release coating in a pattern which when viewed conveys certain intelligence, (b) then applying to said lower surface of said backing sheet, including at least portions of said first release coating, a printed layer comprising background color and a visible graphic different in appearance from said pattern of said release coating, (c) then substantially covering the thus produced lower surface of said composite tape with a layer of adhesive, (d) at some time in the process applying a second release coating to the upper surface of said backing sheet, and (e) winding said tape upon itself to form a multi-turn roll in which said second release coating of one turn directly engages said adhesive layer of the adjacent turn.

* * * * *